US005243920A

United States Patent [19]

Lamson et al.

[11] Patent Number: 5,243,920

[45] Date of Patent: Sep. 14, 1993

[54] BRACE CONNECTION FOR FRAME BRACED TRUCK

[75] Inventors: So'n Lamson; Zheng Xu, both of Kingston, Canada

[73] Assignee: UTDC Inc., Kingston, Canada

[21] Appl. No.: 734,272

[22] Filed: Jul. 22, 1991

[51] Int. Cl.[5] ..... B61F 5/00

[52] U.S. Cl. ..... 105/165; 105/168; 105/182.1

[58] Field of Search ..... 105/165, 167, 168, 182.1, 105/183; 403/390, 395, 400

[56] References Cited

U.S. PATENT DOCUMENTS

| | | | |
|---|---|---|---|
| 42,202 | 7/1865 | Lecky | 105/165 |
| 569,044 | 6/1896 | Hardie | 105/165 X |
| 935,951 | 10/1909 | Barber | 105/186 |
| 1,640,179 | 8/1927 | Buckwalter | 105/182.1 |
| 2,347,628 | 4/1944 | Cottrell | 105/208.2 |
| 2,908,230 | 10/1959 | Dean | 105/198.1 |
| 3,528,374 | 9/1970 | Wickens | 105/168 |
| 3,795,203 | 3/1974 | Sundby | 105/182.1 |
| 3,965,825 | 6/1976 | Sherrick | 105/224.1 |
| 4,067,261 | 1/1978 | Scheffel | 105/168 |
| 4,067,262 | 1/1978 | Scheffel | 105/168 |
| 4,111,131 | 9/1978 | Bullock | 105/224.1 |
| 4,131,069 | 12/1978 | List | 105/168 |
| 4,134,343 | 1/1979 | Jackson | 105/167 |
| 4,136,620 | 1/1979 | Scheffel et al. | 105/168 |
| 4,162,653 | 7/1979 | Wickens | 105/166 |
| 4,311,407 | 1/1982 | Doyle | 403/390 |
| 4,483,253 | 11/1984 | List | 105/168 X |
| 4,570,544 | 2/1986 | Smith | 105/165 |

FOREIGN PATENT DOCUMENTS

| | | |
|---|---|---|
| 79918 | 10/1976 | Australia . |
| 1192787 | 9/1985 | Canada . |
| 1208340 | 10/1970 | United Kingdom . |
| 1571499 | 7/1980 | United Kingdom . |

OTHER PUBLICATIONS

"Properties of Cross-Braced Trucks"; by Roy E. Smith and Ronald J. Anderson; pp. 1-11, Nov. 1982.

"The Theory and Performance of Frame-Braced Freight Trucks"; by Roy E. Smith; pp. 111-117; Attachment pp. 1-6.

"Performance Analysis and Testing of a Conventional Three-Piece Freight Car Truck Retrofitted To Provide Axle Steering"; by Marcotte, Caldwell and List; pp. 1-57, Nov. 1978.

*Primary Examiner*—Robert J. Oberleitner
*Assistant Examiner*—Kevin D. Rutherford
*Attorney, Agent, or Firm*—Bell, Seltzer, Park & Gibson

[57] ABSTRACT

A truck is braced by diagonal struts that are clamped to one another at their intersection. The clamp includes a pair of plates each having a channel to receive one of the struts. An elastomeric member is located between the struts and the plates to permit some flexibility in a vertical direction.

5 Claims, 2 Drawing Sheets

BRACE CONNECTION FOR FRAME BRACED TRUCK

The present invention relates to a railroad truck.

In U.S. Pat. No. 4,570,544 there is disclosed a railroad truck having a pair of side frames supported on a pair of longitudinally spaced wheelsets. To improve the stability of the truck, braces extend between the side frames to improve the resistance to lozenging of the side frames. Elastomeric members are placed between the wheelsets and the side frames to decrease the yaw stiffness of the wheelsets. As a result, the yaw stiffness and the lateral stiffness of the truck can be selected to provide optimum stability for the truck.

In the preferred embodiment of the above patent, the bracing between the side frames is formed from a pair of diagonal struts secured to each of the side frames. The struts intersect in plan, i.e. they cross each other, and are interconnected at their intersection by a simple clamp in the form of a U-bolt.

The arrangement shown in the above patent has dramatically increased the critical velocity of conventional trucks and has found widespread acceptance in commercial operation. It has, however, been found that the interconnection of the bracing must be carefully controlled in order to obtain the optimum benefits from such a truck.

In practice, the U-bolt connection shown in U.S. Pat No. 4,570,544 was found to provide insufficient stiffness in the horizontal plane to produce the optimum critical velocity for the truck. This was assumed to be a result of the point contact between the struts which essentially acted as a pivotal connection. This problem was aggravated in use by wear or abrasion between the struts which led to localized wear and weakness.

To overcome the above problems, it was proposed to weld the struts to one another at their intersection. This produced the necessary stiffness in the horizontal plane but in severe applications, i.e. a poorly maintained track, the torsional loads imposed on the truck, i.e. one wheel dropping relative to the others at a rail joint, produce unacceptably high stress concentrations in bending in the struts.

It is therefore an object of the present invention to provide a truck in which a controlled stiffness is provided between the struts and the above disadvantages are obviated or mitigated.

According to the present invention, there is provided a truck comprising a pair of longitudinally spaced wheelsets, a pair of laterally spaced side frames extending between and supported by said wheelsets, a bolster extending between said sideframes to support a vehicle body, and a brace operable upon said side frames to control relative longitudinal movement therebetween, said brace including a pair of struts oppositely inclined to the longitudinal axis of the truck and each extending between the side frames, said struts being disposed to intersect in plan, and said brace further including a clamp located at the intersection of said struts to secure said struts to one another, said clamp inhibiting relative movement between said struts in a generally horizontal plane while permitting limited relative movement in a vertical plane to accomodate torsional movement between said side frames.

It is preferred that the clamp includes an elastomeric element interposed between the struts and it is further preferred that the clamp includes a pair of plates disposed on opposite sides of the struts and secured to one another. In this arrangement, the elastomeric element would be also located between the plates.

An embodiment of the invention will now be described by way of example only with reference to the accompanying drawings in which FIG. 1 is a side view of a truck;

Figure 1:
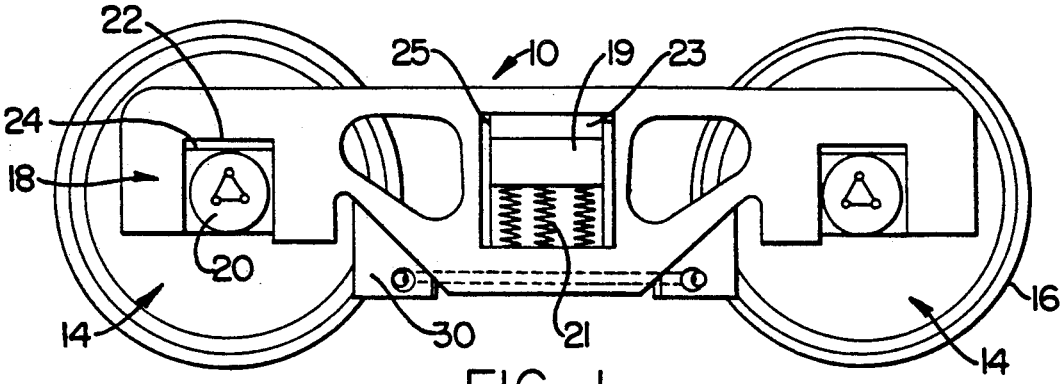
Figure 2:
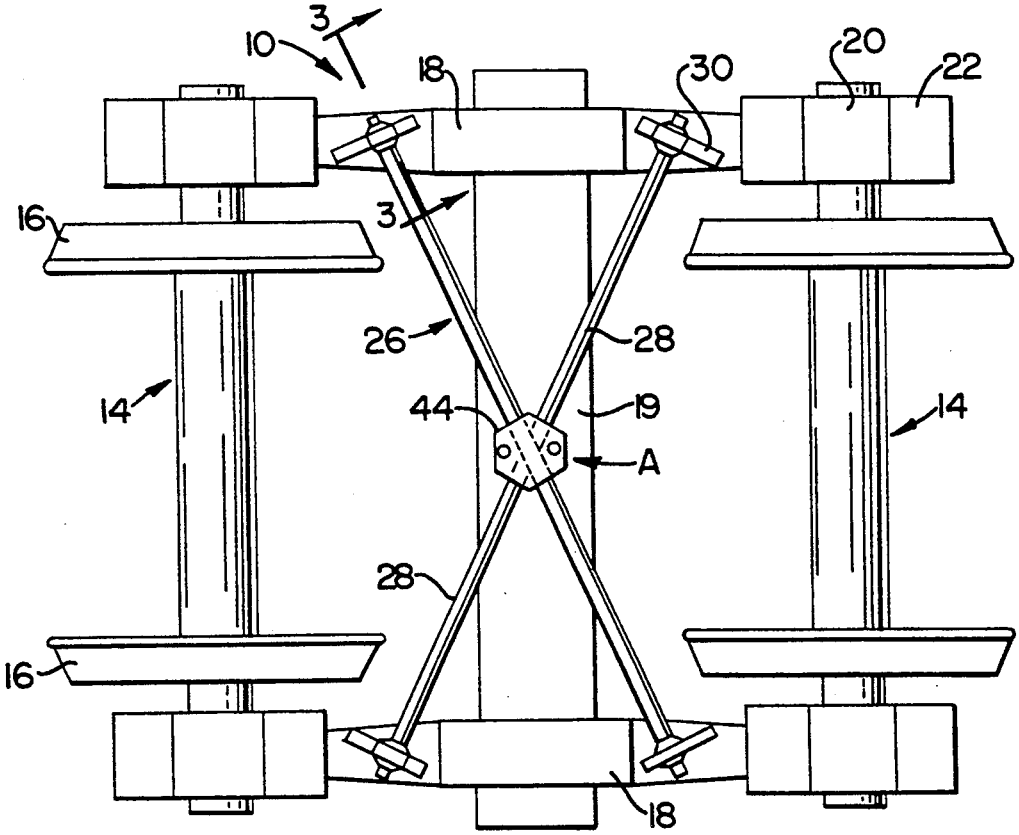
FIG. 2 is a plan view or the truck shown in FIG. 1.

Referring therefore to FIGS. 1 and 2, a truck 10 comprises a pair of laterally spaced wheelsets 14 each having a pair of flanged wheels 16. Opposite ends of the wheelsets support a pair of longitudinally extending side frames 18. As more clearly shown in FIG. 1, each of the wheelsets includes a bearing assembly 20 located within a yoke 22 formed at the end of the side frames 18 with an elastomeric element 24 interposed between the bearing assembly and the yoke 22. A bolster 19 extends between side frames 18 and is resiliently supported on springs 21 located within an aperture 23 and guided by side walls 25. Bolster 19 resiliently supports the vehicle body (not shown) on the truck in a conventional manner.

Figure 3:
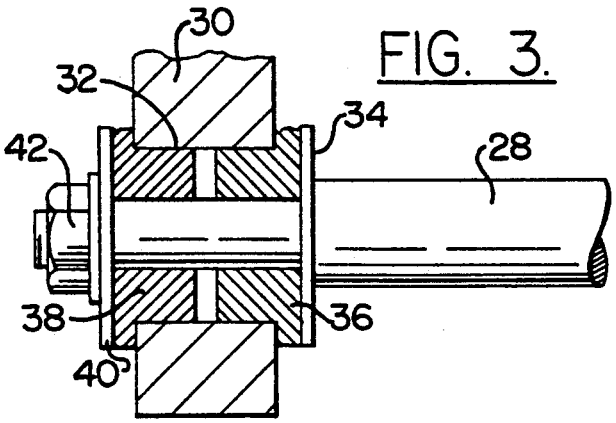
FIG. 3 is a view on the line 3—3 of FIG. 2.

A brace generally indicated at 26 extends between the side frames 18 and comprises a pair of oppositely inclined struts 28. Opposite ends of each of the struts 28 is secured to a plate 30 depending from the side frame 18. As shown in FIG. 3, plate 30 includes an aperture 32 to receive one end of the strut 28 which itself carries an enlarged washer 34. An elastomeric member 36 is interposed between the washer 34 and the plate 30 and a similar elastomeric member 38 is located on the opposite side by a further washer 40 and a nut 42. As such, a resilient connection is provided between the strut 28 and the side frame 18.

The above described structure is similar to that shown in U.S. Pat. No. 4,570,544 from which it will be understood that by selecting the stiffnesses of the elastomeric pads 24 and of the brace 26, the critical velocity of the truck 10 can be increased.

Figure 4:
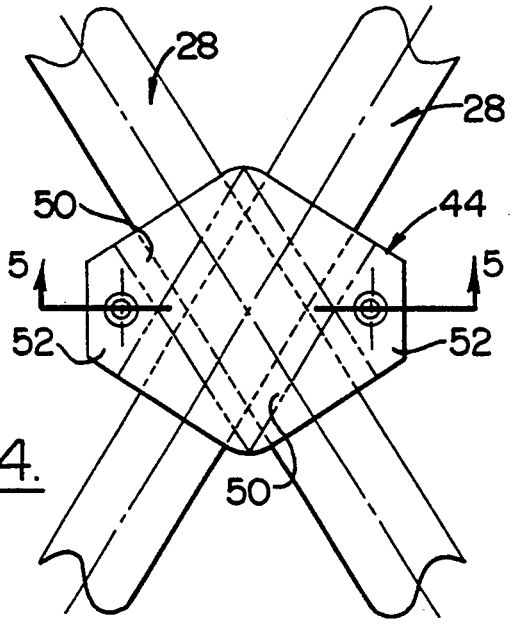
FIG. 4 is an enlarged view of a portion of the truck indicated by arrow A in FIG. 1.
Figure 5:
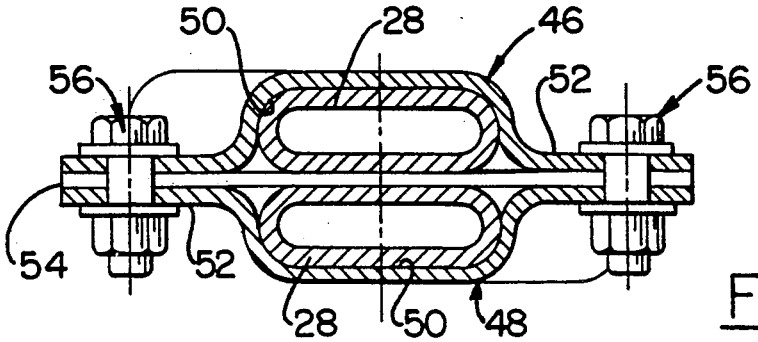
FIG. 5 is a view on the line 5—5 of FIG. 4.

As most clearly seen in FIG. 1, the struts 28 intersect when viewed in plan and are connected at their intersection by a clamp generally designated 44. Clamp 44 can be seen more clearly in FIGS. 4 and 5 and comprises a pair of plates 46,48 disposed on opposite sides of the struts 28. Each of the plates 46,48 is formed as an irregular hexagon and is of similar shape in plan. As can be seen most clearly in FIG. 5, each plate 46,48 has a channel portion 50 complimentary in shape to the oval cross-section of each of the struts 28 with a flange 52 projecting laterally to either side of the channel 50. The channels 50 in the upper and lower plates 46,48 are oppositely inclined so as to be aligned with the longitudinal axis of a respective one of the struts but the flanges 52 lie adjacent the generally horizontal plane in which the struts 28 lie. The flange 52 on either side of the channel 50 is generally triangular to provide an edge that overlies the channel in the other plate 50 with a portion located in the vertices between the struts 28. It will be noted that the peripheral edges of the plates 46,48 that extend across the channels 50 are disposed normal to the longitudinal axis of the respective struts 28.

An elastomeric member 54 is interposed between the plates 46,48 and the struts 28 at their point of intersection. The elastomeric member 54 is located between the flanges 52 of the plates 46,48 and a pair of bolts 56 extend through both plates and the elastomeric member to clamp the struts 28 to one another.

The braces 28 are clamped by the plates 46,48 with the interior surface of the channels 50 bearing directly on the outwardly directed faces of the respective struts 28. This clamping rigidly restrains the braces in the generally horizontal plane but the elastomeric material 54 disposed between the braces allows the individual struts to move a small amount in the vertical direction. Moreover, the elastomeric material 54 reduces abrasion between the braces and thus improves their fatigue life. Similarly, the disposition of the peripheral edges of the plates 46,48 perpendicular to the struts 28 also minimizes a local stress concentration in the braces.

In a typical welded assembly, the allowable stress in a strut was calculated to be 41 Mpa. However, in a worst case simulation, ie. upon displacement of one wheel relative to the other during curving, such as when negotiating an uneven track, an applied stress of 212 Mpa was imposed in the struts. By way of comparison, with the arrangement shown in FIGS. 1–5, a maximum applied stress of 145 Mpa was calculated with the struts having an allowable stress of 172 Mpa. The shear stiffness in the horizontal plane of the brace was not adversely affected as the flexibility of the elastomeric pad is offset by the larger clamping area of the plates 46,48.

Thus, the clamp 44 provides effective clamping of the struts 28 to provide the necessary lateral stiffness between the side frames but at the same time permits a reduction in the bending stresses induced in the struts leading to an improved service capability.

It will be appreciated that additional bolts could be located in the other vertices of the plates 46,48 if necessary to increase the stiffness in the clamping area.

We claim:

1. A truck comprising a pair of longitudinally spaced wheelsets, a pair of laterally spaced side frames extending between and supported by said wheelsets, a bolster extending between said sideframes to support a vehicle body, and a brace operable upon said side frames to control relative longitudinal movement therebetween, said brace including a pair of struts oppositely inclined to the longitudinal axis of the truck and each extending between the side frames, said struts being disposed to intersect in plan, and said brace further including a clamp located at the intersection of said struts to secure said struts to one another, said clamp including an elastomeric element interposed between said struts and a pair of plates disposed on opposite sides of said struts and secured to one another, each of said plates including a channel portion to accommodate one of said struts and a pair of flanges, each of said flanges being located on an opposite side of said channel and disposed adjacent a plane containing each of said struts, said clamp inhibiting relative movement between said struts in a generally horizontal plane whilst permitting limited relative movement in a vertical plane to accommodate torsional movement between said side frame.

2. A truck according to claim 1 wherein said elastomeric element is located between said flanges.

3. A truck according to claim 2 wherein said plates are secured to one another by fastening means located in the flanges at the vertices of said struts.

4. A truck according to claim 1 wherein said plates include peripheral edges disposed normal to the axis of respective ones of said struts.

5. A truck according to claim 1 wherein said struts are generally oval in cross-section at their intersection.

* * * * *